US009051752B1

(12) United States Patent
Muthusami

(10) Patent No.: US 9,051,752 B1
(45) Date of Patent: Jun. 9, 2015

(54) SECURE MEMORIAL STRUCTURES FOR CREMATION INTERMENT

(76) Inventor: Jayakumar Muthusami, College Station, TX (US)

( * ) Notice: Subject to any disclaimer, the term of this patent is extended or adjusted under 35 U.S.C. 154(b) by 0 days.

(21) Appl. No.: 12/951,443

(22) Filed: Nov. 22, 2010

Related U.S. Application Data

(60) Provisional application No. 61/263,331, filed on Nov. 20, 2009.

(51) Int. Cl.

| | |
|---|---|
| ***E04H 13/00*** | (2006.01) |
| ***A47B 67/04*** | (2006.01) |
| ***A47B 47/00*** | (2006.01) |
| *A47B 81/00* | (2006.01) |

(52) U.S. Cl.
CPC ..... *E04H 13/006* (2013.01); *A47B 81/00* (2013.01); *E04H 13/00* (2013.01); *E04H 13/003* (2013.01); *A47B 67/04* (2013.01)

(58) Field of Classification Search
CPC ..... E04H 13/006; E04H 13/00; E04H 13/003; A47B 67/04; A47B 47/00; A47B 81/00; A61G 17/00
USPC ..... 52/128, 133, 134, 135, 136, 137, 139, 52/202, 173.3, 203, 656.7; 312/198, 312/257.1, 265.5, 365.6, 350, 351; 70/78, 70/81, 95, 100; 109/53, 56, 57, 58, 64, 73
See application file for complete search history.

(56) References Cited

U.S. PATENT DOCUMENTS

| | | | | | |
|---|---|---|---|---|---|
| 1,209,027 | A * | 12/1916 | Quade | 217/12 R |
| 1,833,081 | A * | 11/1931 | Kilmer | 217/36 |
| 3,347,610 | A * | 10/1967 | Pilliod | 312/263 |
| 3,379,483 | A * | 4/1968 | Oldford | 312/263 |
| 3,790,244 | A * | 2/1974 | Stackhouse | 312/215 |
| 3,990,198 | A | 11/1976 | Ortutay | |
| 4,110,946 | A * | 9/1978 | Louther, Jr. | 312/264 |
| 4,521,999 | A | 6/1985 | Flanagan | |
| 4,607,417 | A | 8/1986 | Hancovsky | |
| 4,614,066 | A * | 9/1986 | Koppenberg | 52/134 |
| 4,750,794 | A * | 6/1988 | Vegh | 312/263 |
| 5,195,812 | A | 3/1993 | Eickhof | |
| 5,408,787 | A * | 4/1995 | Barnett | 52/134 |
| 5,477,594 | A * | 12/1995 | LePage | 27/1 |
| 5,622,014 | A | 4/1997 | Weiss | |
| 5,802,781 | A | 9/1998 | Eickhof | |
| 5,979,124 | A | 11/1999 | Branan | |
| 6,250,025 | B1 | 6/2001 | Darby | |
| 6,513,352 | B1 | 2/2003 | Mainville | |
| 6,553,727 | B2 | 4/2003 | Thomas et al. | |
| 6,578,323 | B1 | 6/2003 | Zartman et al. | |
| 7,356,891 | B2 * | 4/2008 | Freeman | 27/35 |
| 7,415,800 | B2 | 8/2008 | Stienwand | |
| 7,421,765 | B1 | 9/2008 | Kaiser | |
| 7,788,860 | B2 | 9/2010 | Bartman et al. | |
| 7,914,091 | B1 * | 3/2011 | Joyce | 312/263 |
| 2008/0122327 | A1 * | 5/2008 | Wu | 312/257.1 |
| 2008/0313981 | A1 * | 12/2008 | Donley et al. | 52/203 |
| 2009/0282752 | A1 * | 11/2009 | Stilnovich | 52/133 |

* cited by examiner

*Primary Examiner* — Phi A
*Assistant Examiner* — Omar Hijaz
(74) *Attorney, Agent, or Firm* — Nick A Nichols, Jr.

(57) ABSTRACT

A memorial structure includes a base, sidewalls, a rear wall and a top wall defining one or more compartments having an open front end. One or more divider walls may be incorporated between the left and right sidewalls to form multi-compartment configurations. Removable door panels cover the open ends of the compartments. The memorial structure includes a lock mechanism for each compartment keyed or coded to be locked or unlocked with a unique key that is not useable with any other lock.

14 Claims, 15 Drawing Sheets

FIG. 16
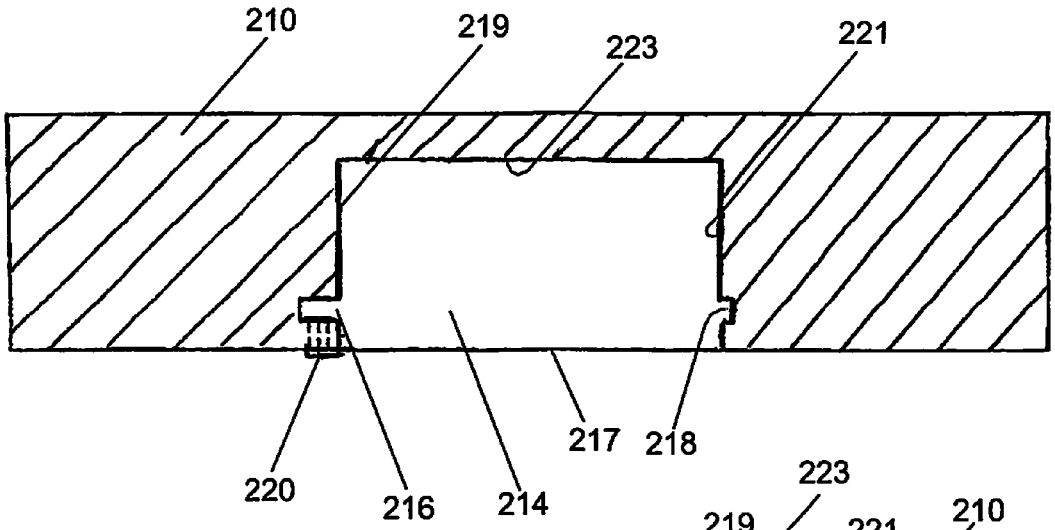
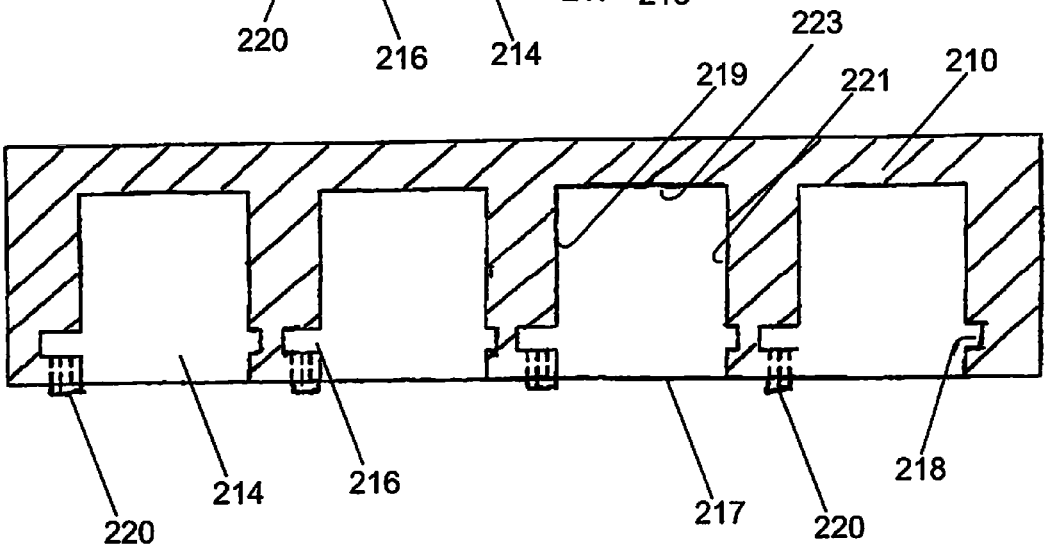
FIG. 17

SECURE MEMORIAL STRUCTURES FOR CREMATION INTERMENT

CROSS-REFERENCE TO RELATED APPLICATION

This application claims the benefit of U.S. Provisional Application Ser. No. 61/263,331, filed Nov. 20, 2009, which application is incorporated herein by reference.

BACKGROUND OF THE INVENTION

The present invention relates generally to the funeral products industry, and more particularly to columbarium and other memorial structures.

Cremation is a growing segment of the funeral industry and there is a growing demand for new and innovative products to personalize and commemorate the lives of the deceased by their loved ones. A Columbarium is a commonly known memorial structure for storing the cremation remains of the deceased.

U.S. Pat. No. 5,979,124 to Brannan discloses a columbarium structure having a horizontal stone base, vertical stone end walls and a stone top forming a chamber for housing a plurality of cremation remains containers. A support frame comprising a plurality of interconnected metal horizontal rods and vertical struts to secure the containers is positioned within the structure. Cover plates adapted to attach to the support frame function as outer doors for the containers.

U.S. Pat. No. 7,356,891 to Freeman discloses a concealed panel locking mechanism that includes a locking member movable within a channel formed in a niche door to either engage or disengage the locking member from a channel formed in the columbarium wall. In one embodiment, the locking member is formed from ferromagnetic material that is moved to a locked or unlocked position by a magnetic force generated by a magnetic key placed on the outside surface of the niche door.

U.S. Pat. No. 4,607,417 to Hancovsky discloses a container for storing and transporting cremation remains. The container is adapted to be inserted in a columbarium niche having an opening surrounded by a niche plate. The container is provided with locking tabs to secure it within the columbarium niche. The niche opening is closed by a faceplate attached to the niche plate by threaded tamperproof fasteners.

U.S. Pat. No. 5,802,781 to Eickhof discloses a soffit lock for retaining a stone cover plate or other facing that is removable to provide access to a columbarium niche or the like. The soffit lock attaches on the inner surface of the cover plate and includes a hook portion wrapping around and over the top of the cover plate. A stud member is threadably received through an orifice formed in the soffit lock. The stud member may be raised to engage a bore formed in the soffit for securing the cover plate to the columbarium.

A disadvantage of existing columbarium systems is that many utilize hardware such as rosettes, fasteners, metal frames and the like to secure the niche door. A generic key is typically used to open all niche doors and thereby permit unauthorized individuals or vandals in possession of a generic key to access any or all of to the columbarium niches.

There is therefore a continuing demand in the funeral industry for new designs and styles of funeral products, particularly products that provide a system for securing memorial structures against tampering or vandalism.

SUMMARY OF THE INVENTION

In accordance with the present invention, a memorial structure includes a base, left and right sidewalls, a rear wall and a top wall defining one or more niches having an open front end. One or more divider walls may be incorporated between the left and right sidewalls to form multi-niche configurations. Removable door panels cover the open ends of the niches. The memorial structure includes a lock mechanism for each niche. A lock mechanism may be actuated by a key coded for use with a specific lock mechanism and no other to secure the decedent's remains from unauthorized access.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 16 is a section view taken along line 16-16 of FIG. 15;

FIG. 17 is a section view taken along line 17-17 of FIG. 15; and

DETAILED DESCRIPTION OF PREFERRED EMBODIMENTS

Figure 2:
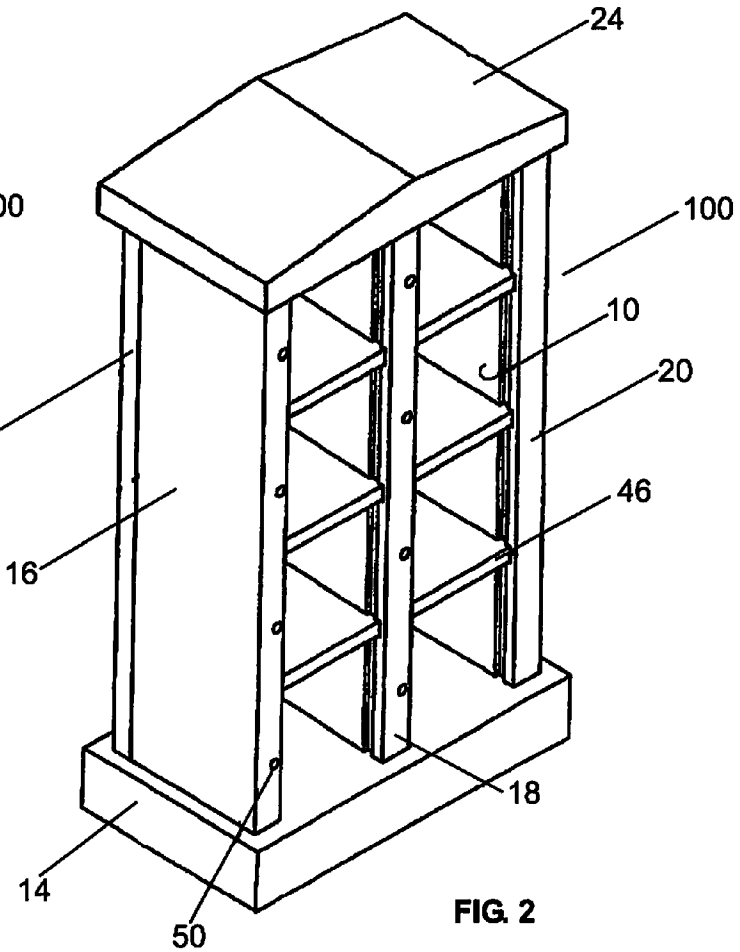
FIG. 2 is a perspective view of the first embodiment of the present invention shown in FIG. 1 with the niche doors removed.
Figure 1:
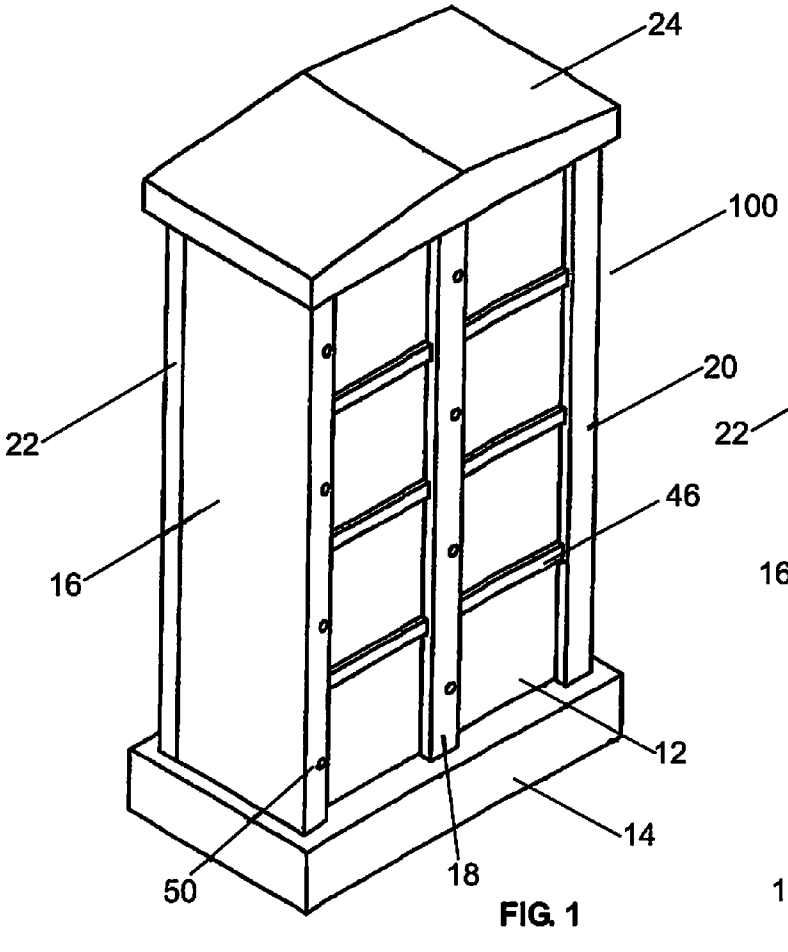
FIG. 1 is a perspective of a first embodiment of a memorial structure in accordance with the present invention.

Referring now to the drawings, like reference numeral designate like and corresponding parts throughout the several embodiments described herein. Referring first to FIGS. 1 and 2, a columbarium structure manufactured in accordance with the present invention is generally identified by the reference numeral 100. The columbarium 100 is manufactured from stone, such as granite or other suitable material. For example, the columbarium 100 may be formed of other material such as metal, concrete, plastic or the like. The columbarium 100 includes a number of chambers or niches 10 arranged in rows and columns. The front of each niche 10 is closed by a removable door or panel 12, also manufactured from stone or other suitable material. It will be understood that the height and width of the columbarium structure may vary to accommodate as many niches 10 as may be required, as for example, the 2-niche, 4-niche, 8-niche and 32-niche configurations, shown in FIGS. 7, 9, 1 and 11, respectively. For purposes of description, the columbarium of the present invention is shown in the drawings as being substantially rectangular in shape but it will be understood that the invention is applicable to any suitable configuration, such as the hexagonal configuration shown in FIG. 19.

Referring still to FIGS. 1 and 2, the columbarium 100 includes a base 14, a left sidewall 16, a divider wall 18, a right sidewall 20, a back wall 22 and a top wall 24. The left, divider and right walls, more clearly shown in FIGS. 3A-3C, extend upwardly from the base 14 and are oriented substantially perpendicular to the base 14. The left sidewall 16 is a substantially rectangular member and includes a front edge 26. An interior, substantially planar surface 28 extends from the front edge 26 to a back edge 30. A vertical channel 32, open at both ends, extends from a top edge 34 to a bottom edge 36 of the sidewall 16. The channel 32 is formed in the surface 28 inward of the front edge 26 of the sidewall 16. That is, the channel 32 is offset inward from the front edge 26 and extends parallel thereto.

The interior surface 28 of the sidewall 16 includes vertically spaced horizontal grooves 33. The grooves 33 are open at the back edge 30 of the sidewall 16 and are substantially parallel to the bottom edge 36 thereof. The grooves 33 extend from the back edge 30 of the sidewall 16, intersect the channel 32 and terminate inward of the front edge 26 of the sidewall 16.

Figures 3A, 3B, 3C:
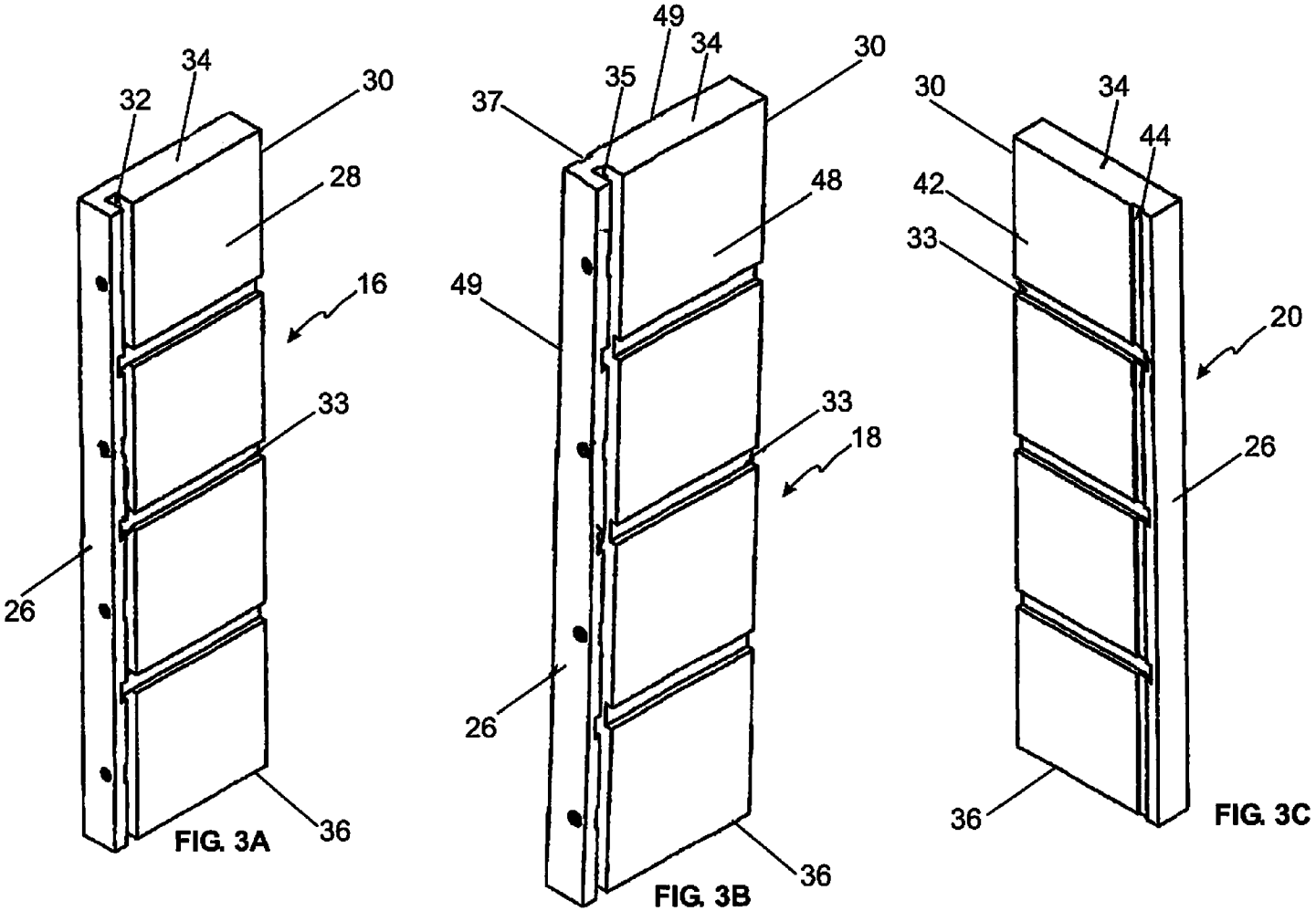
FIGS. 3A-3C are perspective views of the left, middle and right sidewalls, respectively, of the first embodiment of the present invention shown in FIG. 1.

Referring now to FIG. 3C, the right sidewall 20 is shown in greater detail. The sidewall 20 is substantially similar to the left sidewall 16. The sidewall 20 includes a front edge 26, a back edge 30, a top edge 34 and a bottom edge 36. The interior surface 42 of the sidewall 20 includes vertically spaced horizontal grooves 33. A vertical channel 44, open at both ends, extends from the top edge 34 to the bottom edge 36 of the sidewall 20. The channel 44 is substantially similar to the channel 32 in the left sidewall 16 with the exception that the channel 44 of the sidewall 20 is shallower than the channel 32.

Referring now to FIG. 3B, the divider wall 18 of the columbarium 100 is shown in greater detail. The divider wall 18 is substantially similar to the left and the right sidewalls 16 and 20 in size and configuration. However, both sides 48, 49 of the divider wall 18 include vertically spaced horizontal grooves 33. A vertical channel 35, that faces the right sidewall 20, is formed on the right side 48 of the divider wall 18. A vertical channel 37, that faces the left sidewall 16, is formed on the left side 49 of the divider wall 18. The channel 35 is substantially identical in depth and width to the channel 32 formed in the sidewall 16 and the channel 37 is substantially identical in depth and width to the channel 44 formed in the sidewall 20. It will be appreciated by those skilled in the art that the columbarium structure 100 may include a plurality of divider walls 18, as many as may be required to form the desired columbarium configuration.

Referring again to FIGS. 1 and 2, the horizontal grooves 33 formed on the sidewalls 16 and 20 are sized to receive the edges of a substantially planar partition 46 extending transversely between the sidewalls 16 and 20. It will be observed that depending on the location of the partition 46 it will function as the top wall of a niche 10 and the base or bottom wall of a niche 10 above it. The partition 46 is inserted into the grooves 33 from the rear of the columbarium 100 and pushed forward into engagement with the front edge 26 of the sidewalls 16 and 20 and/or the divider wall 18. The back wall 22 is mounted and secured to the base 14 and back edges 30 of the sidewalls 16 and 20 and the divider wall 18. The top wall 24 is secured to the top of the back wall 22, the sidewalls 16 and 20 and the divider wall 18.

Figure 4:
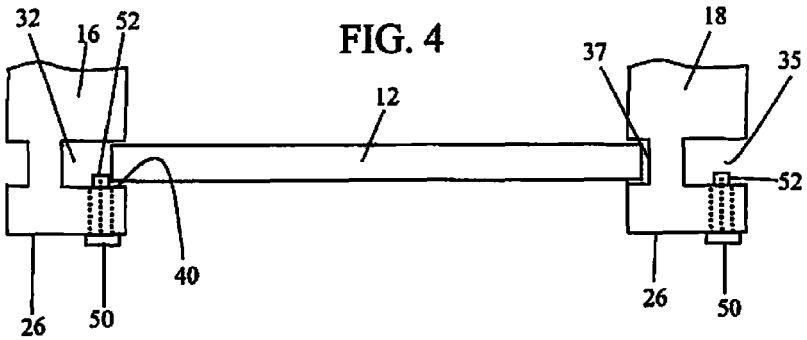
FIG. 4 is an enlarged partial top view illustrating a locking mechanism of the present invention in the locked position.
Figure 5:
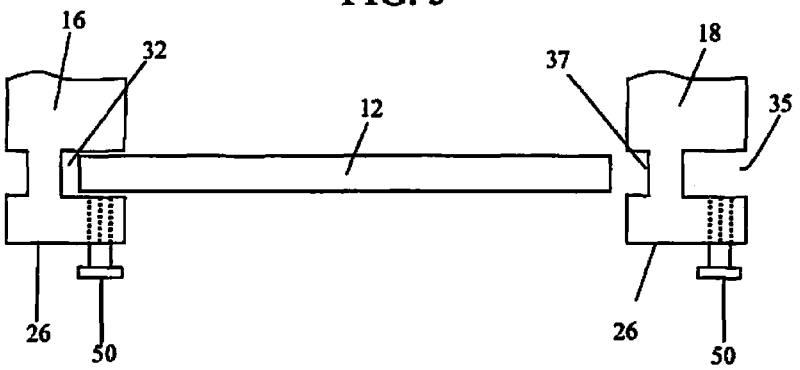
FIG. 5 is an enlarged partial top view illustrating the locking mechanism of the present invention shown in FIG. 4 in the unlocked position.

Each niche 10 defines an enclosure or compartment for receiving the remains of the decedent therein. The front of each niche 10 is open for providing access to the interior of the niche 10. The door 12 is configured to cover the front opening of the niches 10. The door 12 is a panel of granite or other suitable material of sufficient thickness and strength to prevent unauthorized access to the niches 10. The door 12 is secured in the closed position by a lock 50. The lock 50 may be a push-type lock, shown in FIGS. 4 and 5, that employs a push to lock and key to open operation. A lock 50 is provided for each niche 10. Preferably each lock 50 is mounted on the front edge 26 of the left sidewall 16 and the divider wall 18. The lock 50 is mounted in a borehole extending through the front edge 26 of the left sidewall 16 and divider wall 18 and the borehole opens into the channels 32 and 35 of the left sidewall 16 and divider wall 18, respectively. In the locked position shown in FIG. 4, the locking barrel 52 of the lock 50 extends into the channel 32 of the left sidewall 16 and thereby preventing lateral movement of the door 12 into the channel 32. In the unlocked position shown in FIG. 5, the locking barrel 52 is withdrawn from the channel 32. In the unlocked position, the door 12 may be moved laterally so that one edge of the door 12 is advanced into the channel 32 and the opposite edge of the door 12 is completely withdrawn from the channel 37 of the divider 18. The width of the channel 32 is greater than the thickness of the door 12 so that the right side of the door 12 may be pivoted outwardly and door 12 withdrawn from the channel 32.

Figure 6:
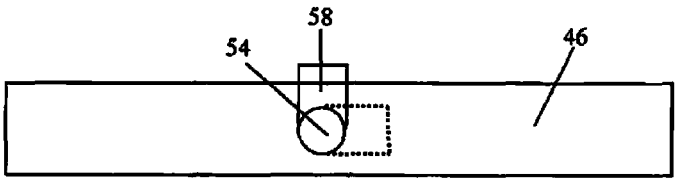
FIG. 6 is an enlarged partial front view illustrating an alternate locking mechanism of the present invention.
Figure 8:
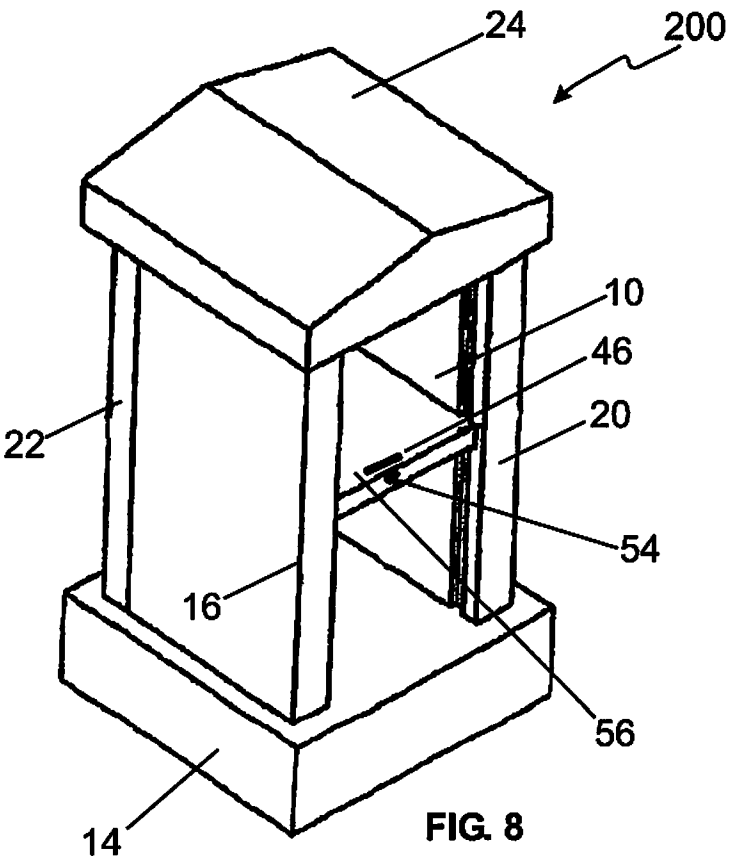
FIG. 8 is a perspective view of the second embodiment of the present invention shown in FIG. 7 with the niche doors removed.
Figure 7:
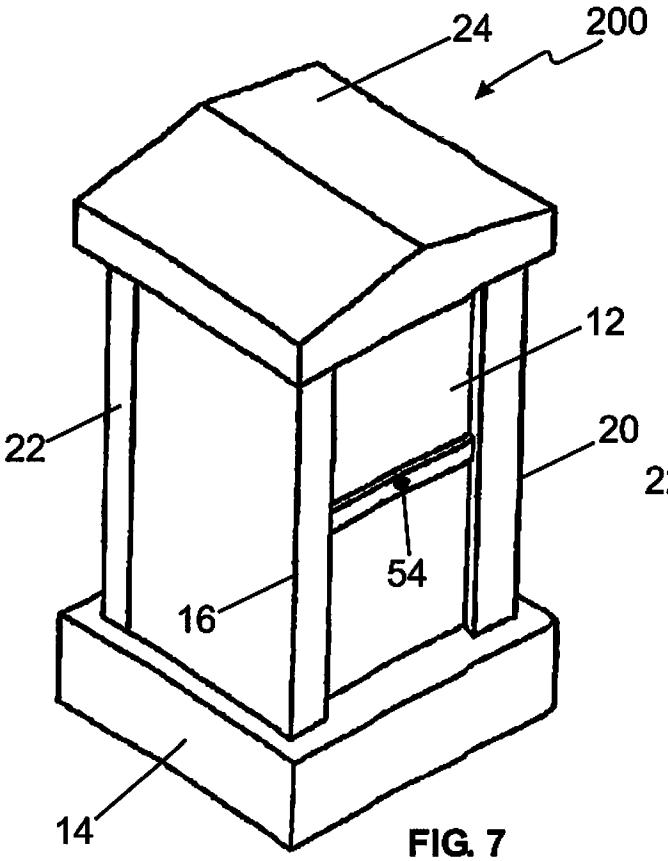
FIG. 7 is a perspective view of a second embodiment of a memorial structure in accordance with the present invention depicting use of the alternate locking mechanism shown in FIG. 6.

Various locking mechanisms may be employed to securely lock the door 12. In a second embodiment 200 of the present invention shown in FIGS. 6, 7 and 8, a cam-type lock 54 is installed in a cam borehole formed in the front edge of the base partition 46 of each niche 10. A corresponding opening 56 extends through the top planar surface of the partition 46 and terminates at the cam borehole. When the door 12 is in the closed position, a slot formed either in the back surface or in the bottom edge of the door 12 is in vertical alignment with the cam opening 56. When the cam lock 54 is turned to the locked position, the locking barrel 58, more clearly shown in FIG. 6, rotates upward and extends through the opening 56 into the slot formed in the back surface or bottom edge of the door 12 to prevent lateral movement of the door 12. Alternatively, the lock 54 may be mounted on the sidewalls of the niches with a corresponding slot in the side edge of the door 12 for engagement therewith.

The lock mechanisms of the preset invention are keyed or coded to be locked or unlocked with a unique key that is not useable with any other lock. That is, a unique key is provided for each niche 10 unlike in existing columbarium systems where a generic key can open all niche doors. In the present invention, family members or other designated individuals may be provided a unique key that will only open the niche containing the remains of the family's departed. If a family owns multiple niches, the locks for all of the family niches may be keyed for a common family key but that is unique for only the family niches.

Figure 10:
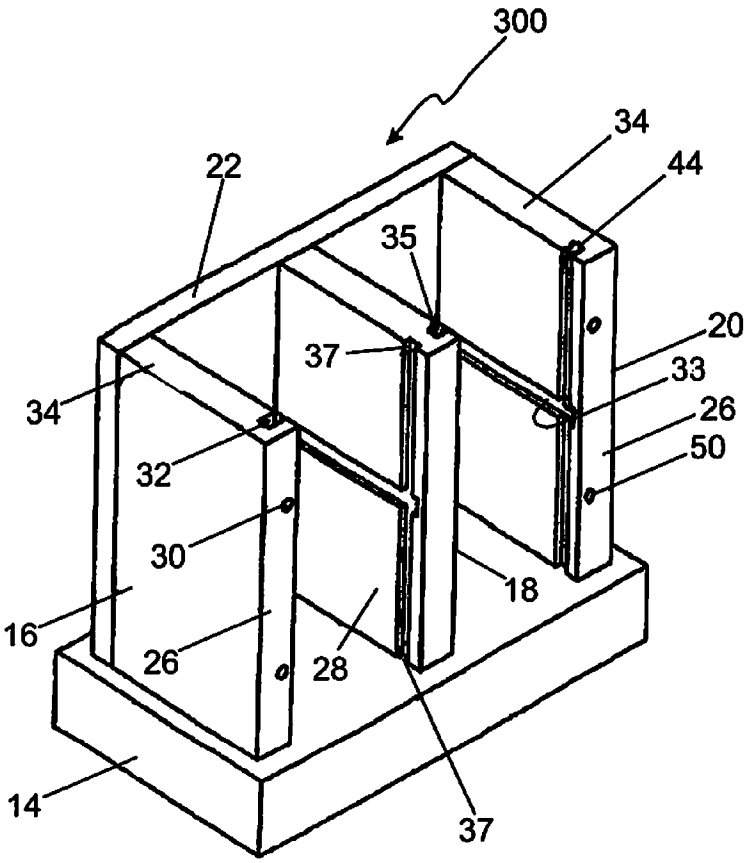
FIG. 10 is a perspective view of the third embodiment of the present invention shown in FIG. 9 with the niche doors and top wall removed.
Figure 9:
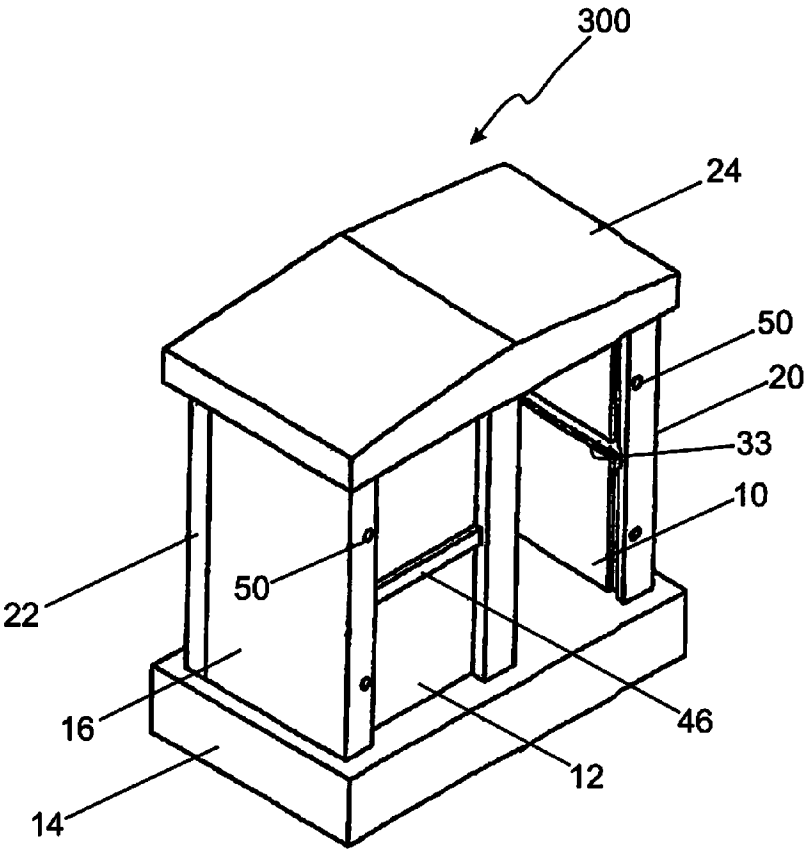
FIG. 9 is a perspective view of a third embodiment of a memorial structure in accordance with the present invention.

Referring now to FIGS. 9 and 10, a third embodiment of a memorial structure in accordance with the present invention is generally identified by the reference numeral 300. The structure 300 is substantially similar to the other structures described above with the exception that lock mechanism 50 is located in the facing edge 26 of the left and right sidewalls 16 and 20. In this configuration, the channels 32 and 44 are deeper for slidably receiving an edge of the door 12 moved to the unlocked position. The divider wall 18 is provided with shallower channels 35 and 37 for slidably receiving the opposite edge of the door 12 when moved to the closed position.

Figure 11:
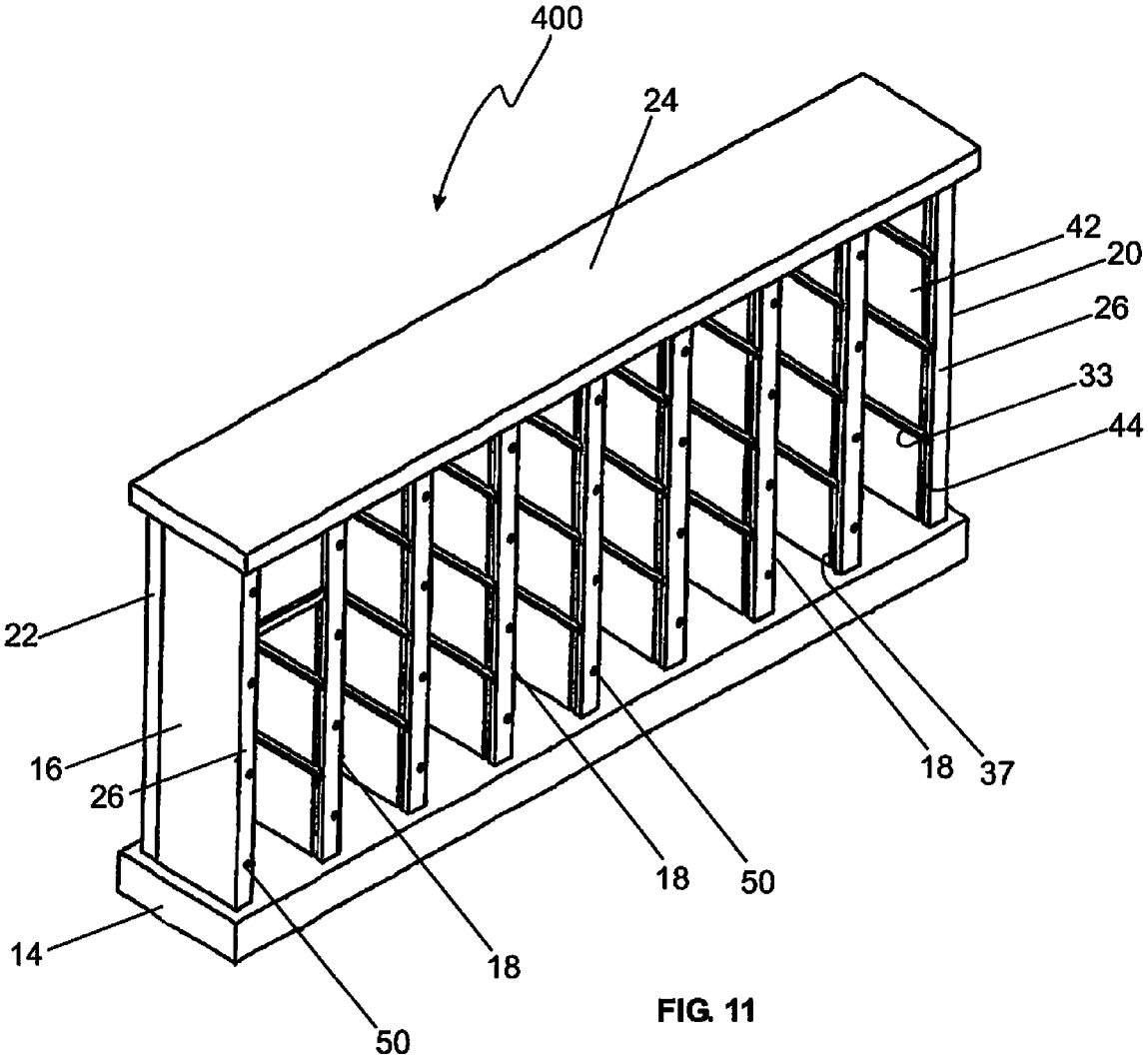
FIG. 11 is a perspective view of a fourth embodiment of a memorial structure of the present invention with the niche doors removed.

Referring now to FIG. 11, a fourth embodiment 400 of a memorial structure in accordance with the present invention comprises a 32-niche configuration forming an extended wall of four rows and eight columns. The 32-niche configuration includes seven divider walls 18 spaced between the left sidewall 16 and the right sidewall 20.

Figure 12:
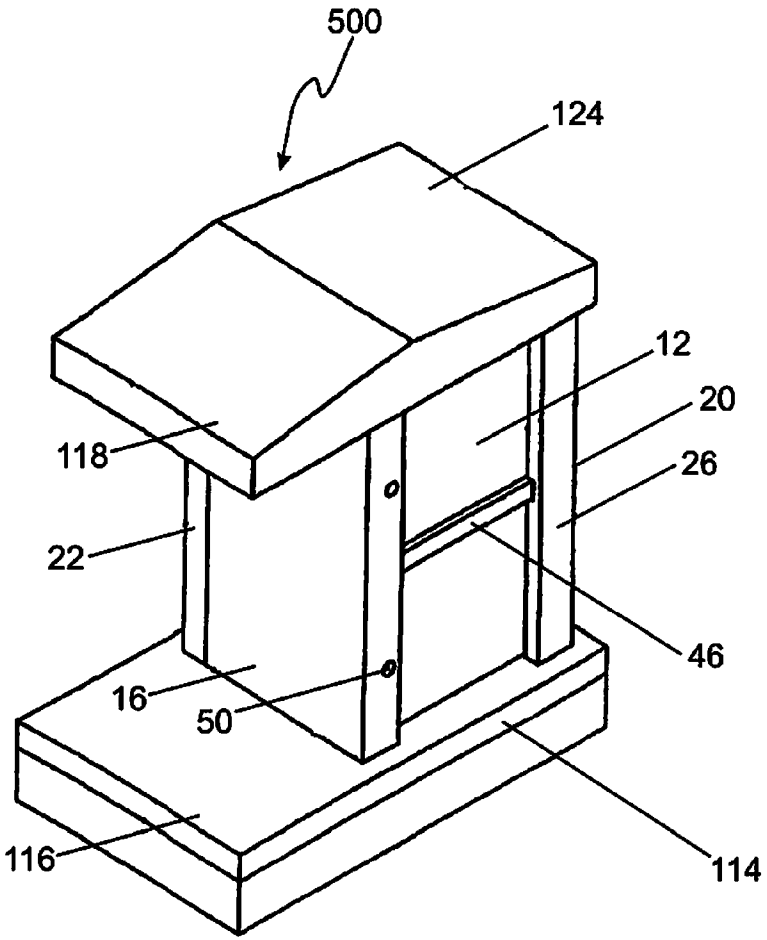
FIG. 12 is a perspective view of a fifth embodiment of a memorial structure of the present invention.
Figure 13:
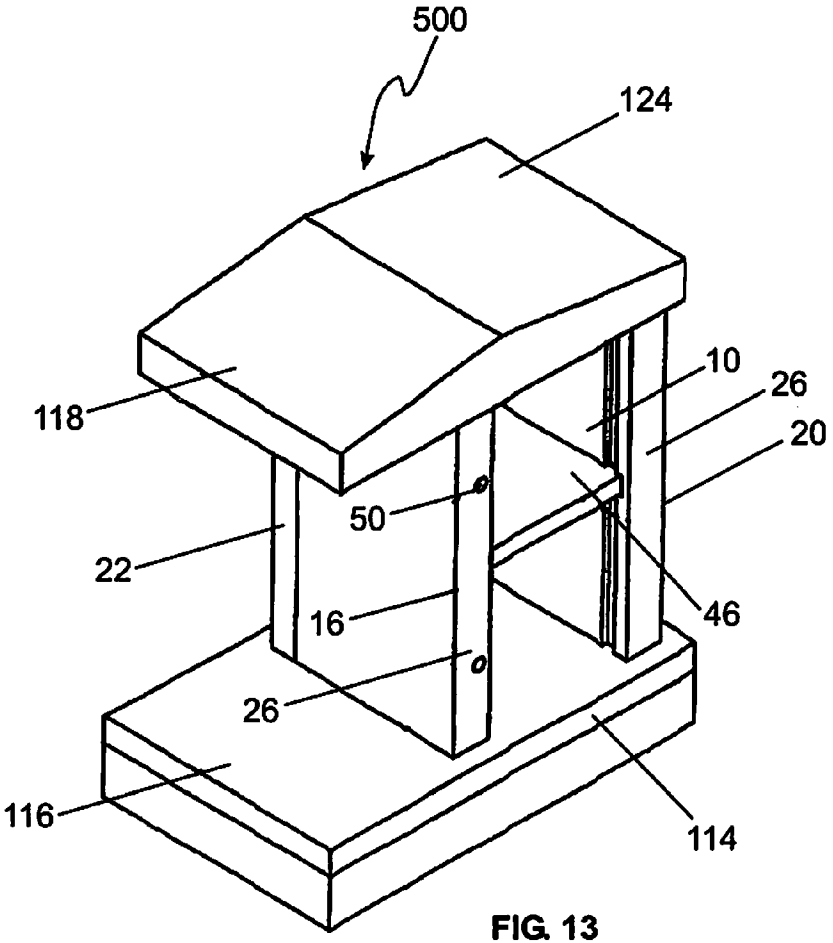
FIG. 13 is a perspective of the fifth embodiment of the present invention shown in FIG. 12 with the niche doors removed.

Referring now to FIGS. 12 and 13, a fifth embodiment 500 of a memorial structure in accordance with the present invention includes a base 114 having an extension 116 projecting to the left of the left sidewall 16. Likewise, the top 124 includes an extension 118 projecting to the left of the sidewall 16. The extensions 116 and 118 define an area therebetween for placement of flowers, statutes and other memorabilia. It is understood that extensions may project from both sides of the memorial structure, if desired.

Figure 14:
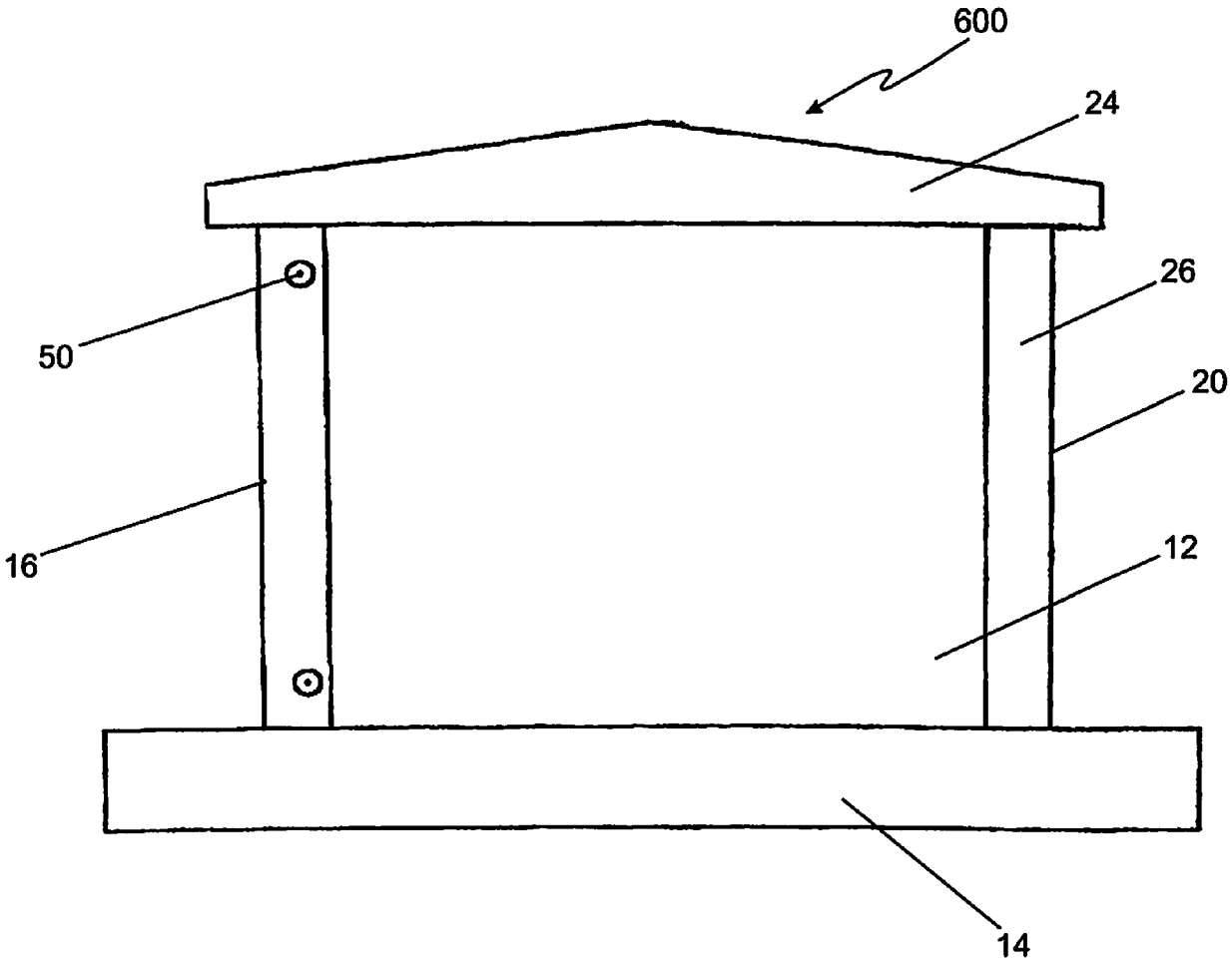
FIG. 14 is a front elevation view of a sixth embodiment of a memorial structure in accordance with the present invention.

Referring now to FIG. 14, a sixth embodiment 600 of a memorial structure in accordance with the present invention includes a single niche. The single niche structure is dimensionally larger than the multi-niche configurations previously discussed herein but otherwise substantially similar structurally.

Figure 15:
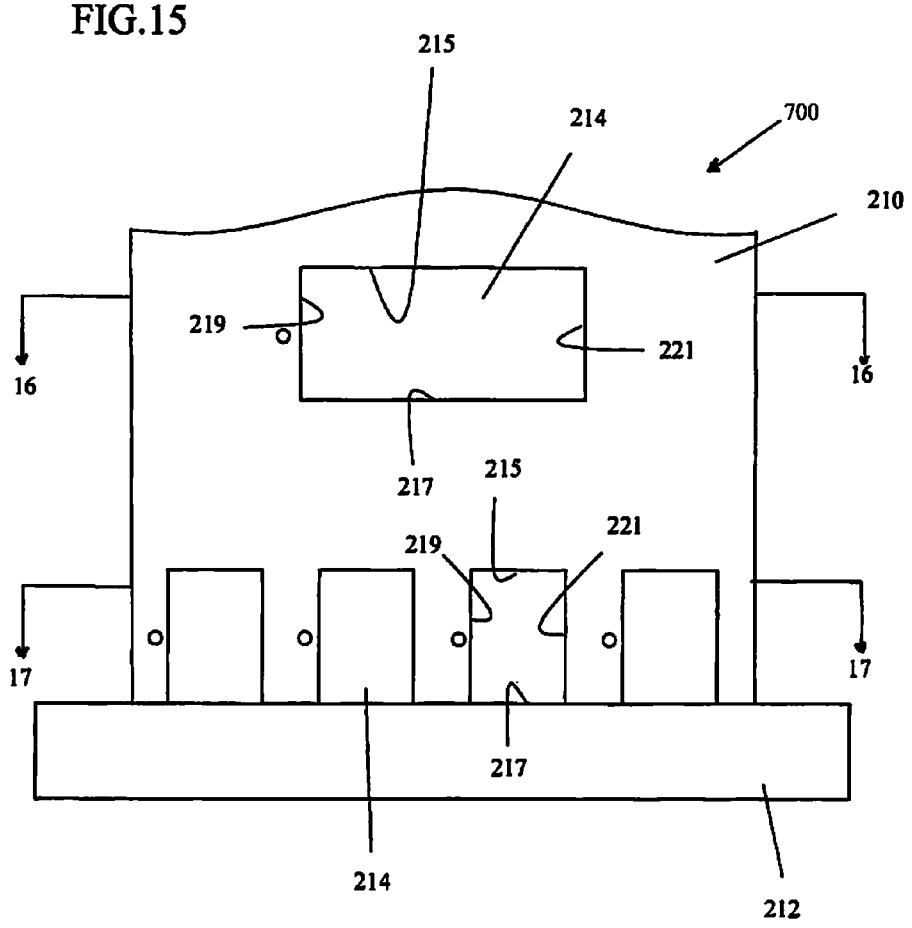
FIG. 15 is a front elevation view of a seventh embodiment of a memorial structure in accordance with the present invention.

Referring now to FIGS. 15-17, a seventh embodiment of a memorial structure in accordance with the present invention generally identified by the reference numeral 700 is shown. The memorial structure 700 includes a tombstone 210 mounted on a base 212. The tombstone 210 comprises a monolithic stone having a plurality of cutouts defining niches 214. The niches 214 are defined by a top wall 215, a bottom wall 217, a left sidewall 219, a right sidewall 221 and a rear wall 223 cut into the tombstone 210. The niches 214 have an open front end closed by a door or panel (not shown in the drawings). The niches 214 include oppositely facing vertical channels 216 and 218, shown in FIGS. 16 and 17, cut into the left sidewall 219 and the right sidewall 221, respectively. The channels 216 and 218 are sized to accommodate the thickness of the door panels. In the embodiment 700, the door panels are mounted by inserting a left side edge of a door panel at an angle into the channel 216 and pivoting the right side edge of the door panel into alignment with the channel 218. The door panel is then moved laterally to the right so that the right side edge of the door panel is received within the channel 218. In the closed position, the locking barrel of a push lock 220 extends into the channel 216 securing the door panel in the locked position.

Figure 18:
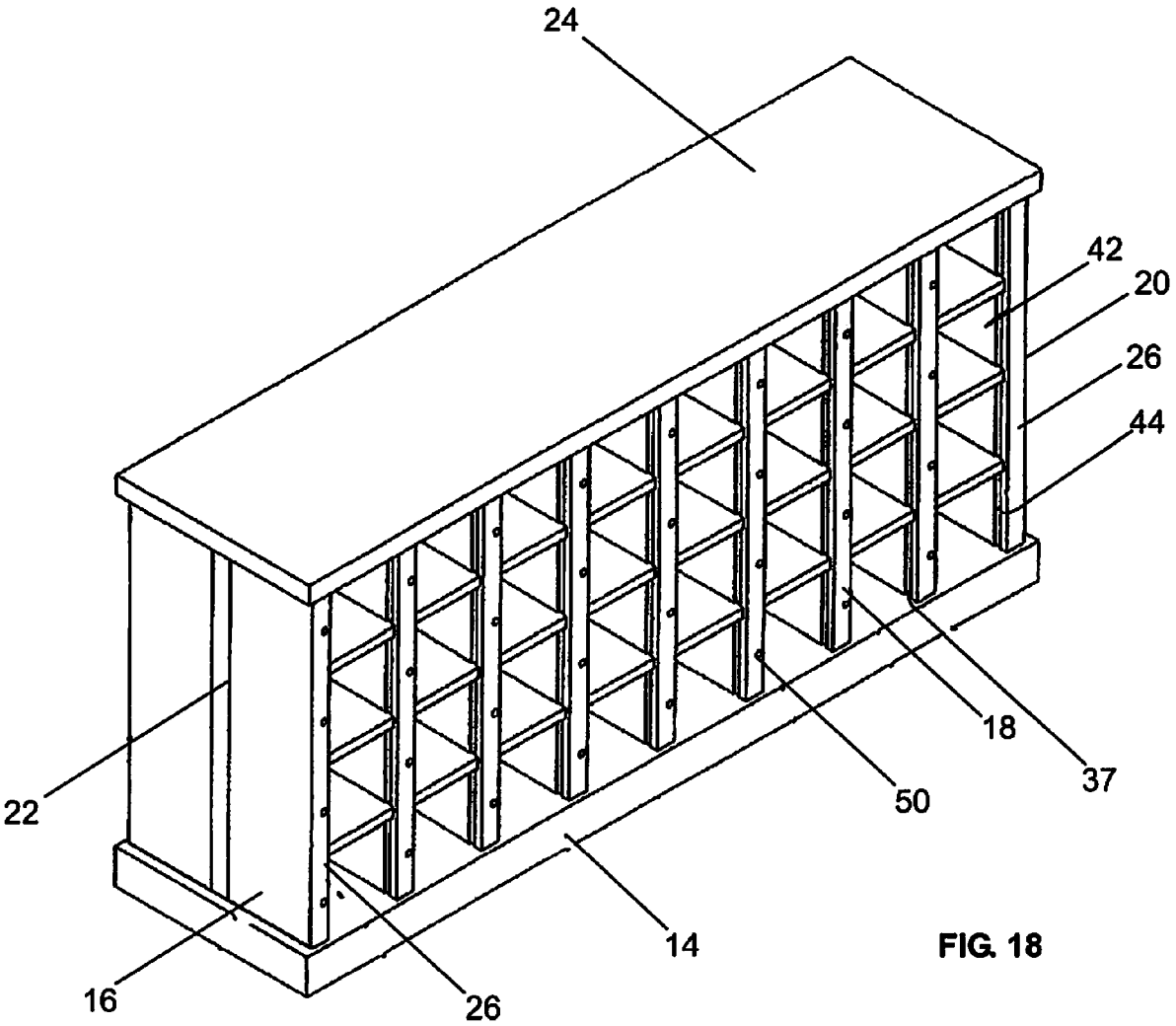
FIGS. 18-24 illustrate alternate configurations of a memorial structure in accordance with the present invention.
Figure 20:
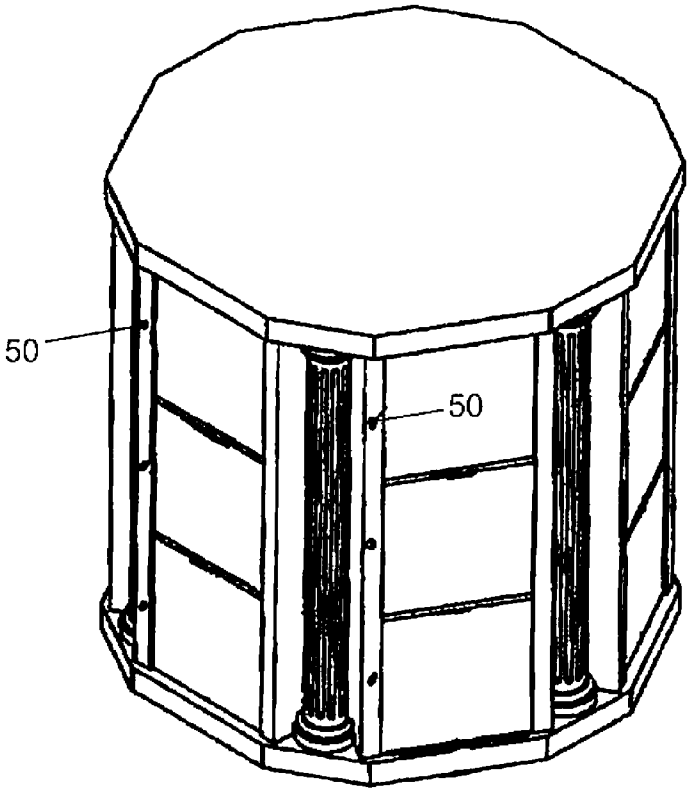
Figure 19:
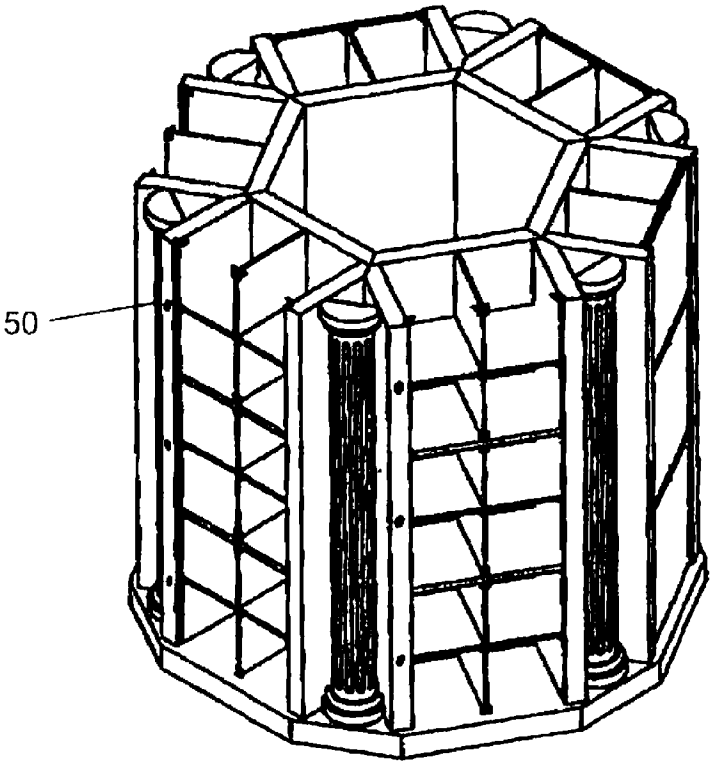
Figure 21:
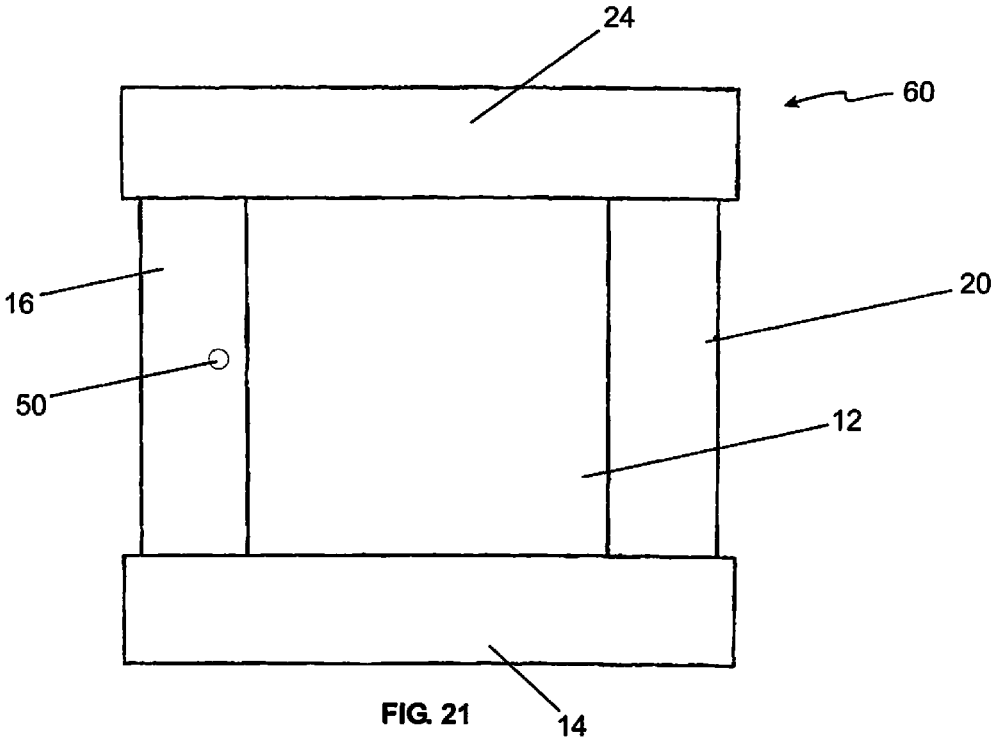
Figure 22:
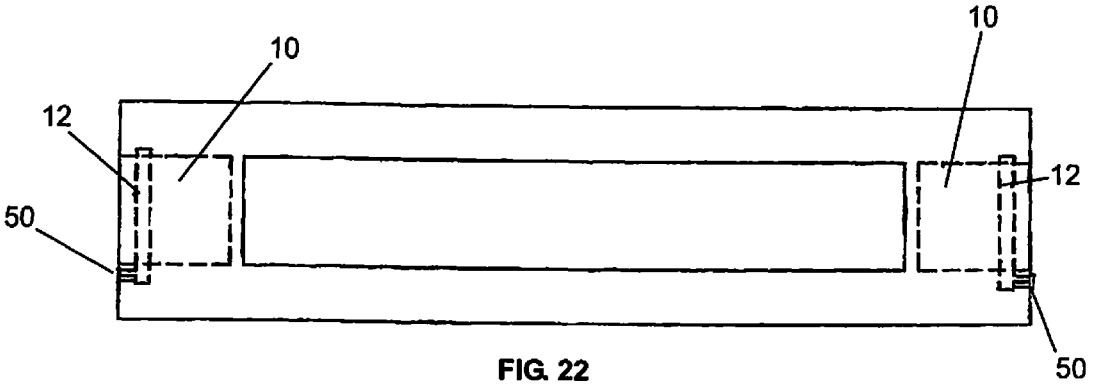
Figure 23:
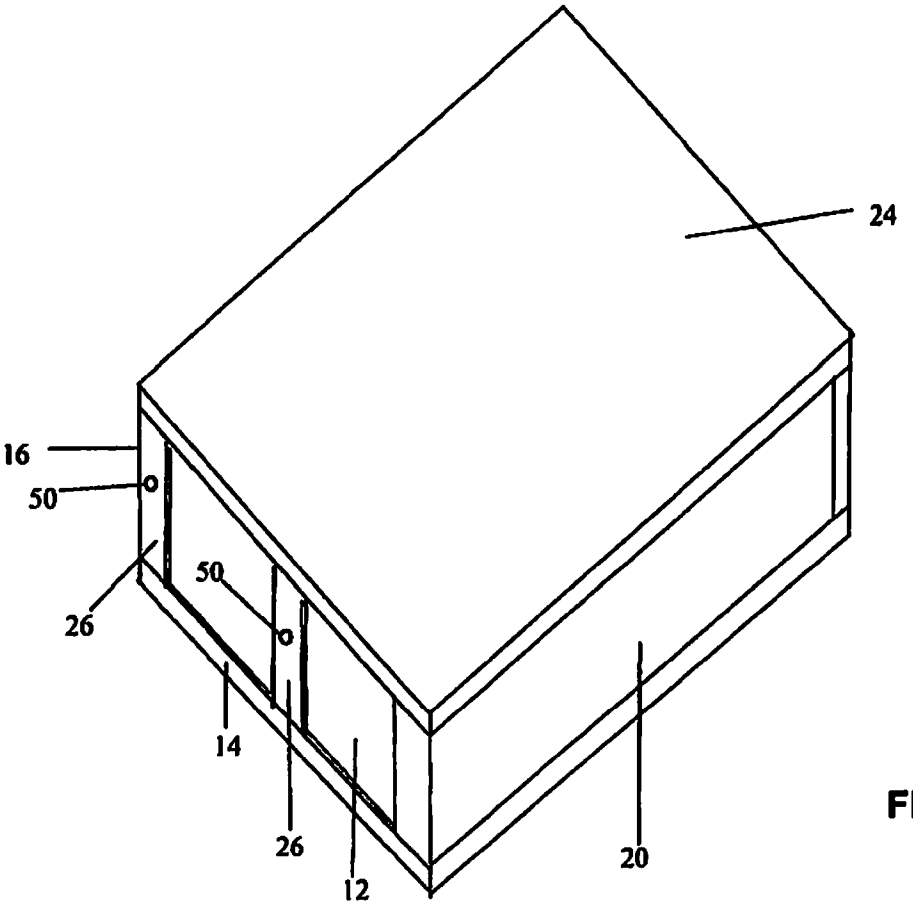
Figure 24:
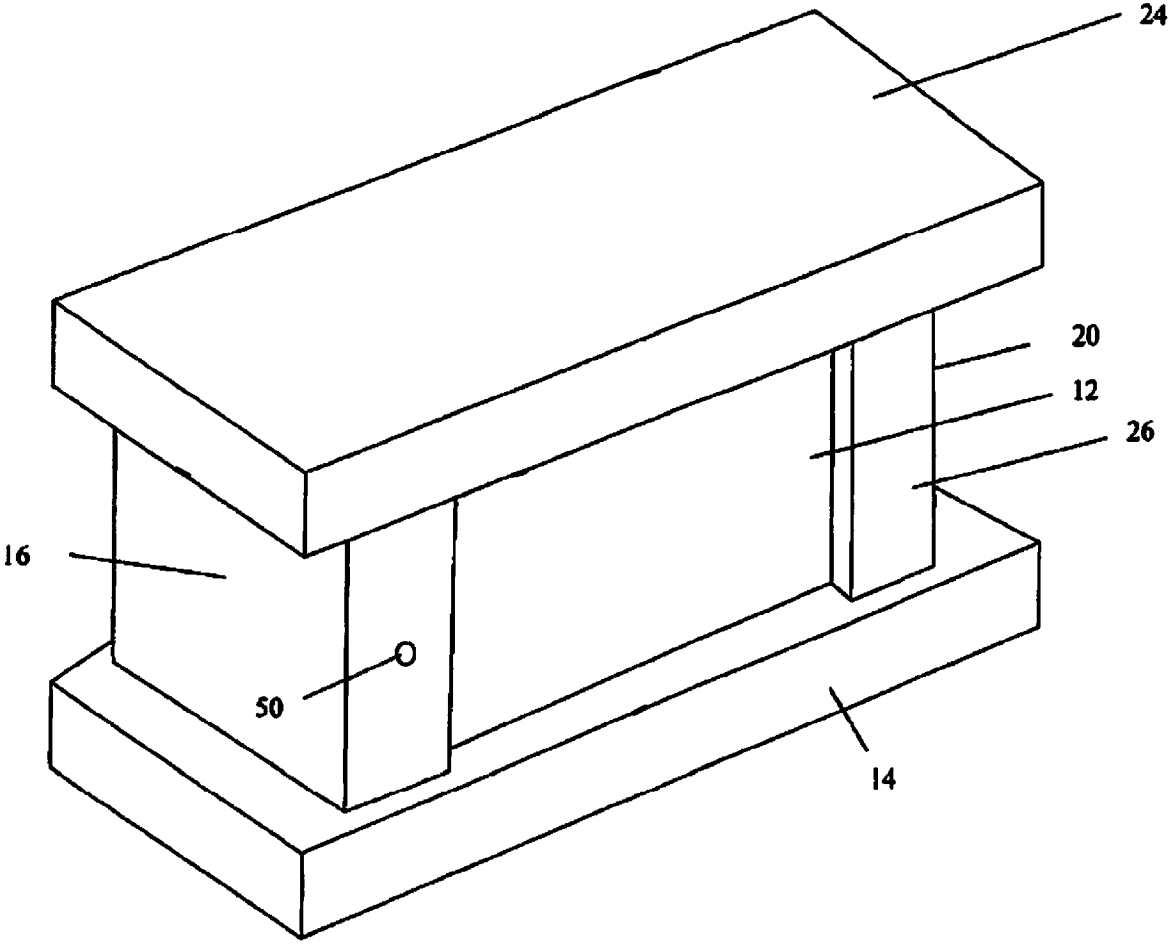

It will be appreciated by those skilled in the art that the structures of the present invention may be manufactured from materials such as concrete, metals, plastics or the like or combinations thereof. Furthermore, the structural configuration of the present invention is not limited to the structures described hereinabove. Other exemplary configurations are shown in FIGS. 18-24. For example, the number of niches may be doubled without extending the longitudinal length of the structure by extending the base 14 and top wall 24 to accommodate niches on both sides of the back wall 22 as shown in FIG. 18. A hexagonal configuration is shown in FIGS. 19 and 20. A memorabilia holder 60 is shown in FIG. 21. The memorabilia holder 60 may be relatively small in size and light weight making it portable and relatively easy to move or transport it to other locations. The present invention may be incorporated in a traditional monument base as shown in FIG. 22 wherein cremation interment niches constructed in accordance with present invention are incorporated in the base of a tablet memorial monument. FIGS. 23 and 24 illustrate a mausoleum and a bench style monument constructed in accordance with the present invention.

While a preferred embodiment of the invention has been shown and described, other and further embodiments of the invention may be devised without departing from the basic scope thereof, and the scope thereof is determined by the claims which follow.

The invention claimed is:

1. A memorial structure comprising:

a) one or more chambers, wherein each said chamber is defined by a base wall, a first sidewall and a second sidewall, a rear wall, a top wall and a removable door panel, wherein each said first and second sidewall includes a substantially vertical front edge;

b) a first channel formed in said first sidewall of each said chamber and a second channel formed in said second sidewall of each said chamber aligned in spaced facing relationship with said first channel and wherein the depth of said first channel is greater than the depth of said second channel, and wherein each said channel is substantially U-shaped in cross section extending substantially parallel to said front edge of a respective said first and second sidewall; and c) a borehole extending from said front edge of said first sidewall and opening into said first channel, a lock fixedly secured in said borehole, wherein said lock includes a locking barrel movable into said first channel for engaging a rear edge of said door panel to maintain said door panel in a locked position and retractable from said first channel permitting said door panel to move laterally to an unlocked position, wherein the rear edge of said door panel is received in said first channel.

2. The structure of claim 1 including at least one substantially planar divider wall extending from said base wall to said top wall positioned in spaced relationship between said first and second sidewalls, said divider wall extending substantially parallel to said first and second sidewalls.

3. The structure of claim 2 including at least two or more divider walls positioned in spaced relationship between said left and right sidewalls.

4. The structure of claim 1 wherein said memorial structure is a columbarium.

5. The structure of claim 4 wherein said columbarium is configured to include two or more of said chambers.

6. The structure of claim 1 including two or more chambers facing in opposite directions from a common back wall.

7. The structure of claim 1 wherein said memorial structure is a mausoleum.

8. The structure of claim 1 wherein said memorial structure is a monolithic tombstone.

9. The structure of claim 8 wherein said tombstone includes two or more of said chambers.

10. The structure of claim 1 wherein said base and said top wall include horizontally extending extensions defining a memorabilia display area therebetween.

11. The structure of claim 1 wherein said memorial structure is configured to form a hexagonal columbarium.

12. The structure of claim 2 including a plurality of said chambers arranged in columns and rows.

13. A memorial monument having a plurality of compartments arranged in columns and rows, comprising:

a) a base, first and second sidewalls, a rear wall, a top wall and at least one divider extending from said base to said top wall positioned in spaced relationship between said sidewalls, said divider extending substantially parallel to said sidewalls;

b) each said first and second sidewall includes a vertically extending sidewall channel proximate a front edge of said first and second sidewalls, and said divider includes vertically extending divider channels facing in opposite directions proximate a front edge of said divider, and wherein said sidewall channels and said divider channels are substantially U-shaped in cross section;

c) wherein said divider channels are in spaced facing relationship with a respective said sidewall channel forming spatially aligned channel pairs, and wherein the depth of one channel of said channel pairs is greater than the depth of the other channel of said channel pairs;

d) said first and second sidewalls and said divider further including vertically spaced horizontal grooves, wherein said horizontal grooves in said first and second sidewalls are spatially aligned with said horizontal grooves in said divider;

e) at least one transverse partition member having opposite ends slidably received in respective aligned pairs of said horizontal grooves, said partition member forming a floor wall of one compartment and a ceiling wall of an adjoining compartment;

f) a removable door panel covering an open front end of each said compartments; and g) a lock associated with each said compartments, wherein said lock is operable to open only the compartment associated with said lock.

14. The memorial monument of claim 13 wherein said lock is fixedly secured in a borehole having an end opening into one of said vertically extending sidewall and divider channels, wherein said lock includes a locking barrel movable into said one vertically extending channel for engaging a rear edge of said door panel to maintain said door panel in a locked position and retractable from said one vertically extending channel permitting said door panel to move laterally to an unlocked position wherein the rear edge of said door panel is received in said one vertically extending channel.

* * * * *